United States Patent [19]

Schmid et al.

[11] 4,091,542

[45] May 30, 1978

[54] MEASURING APPARATUS FOR DETERMINING THE POSITION OF THE ROLLER APRON OF A CONTINUOUS CASTING INSTALLATION

[75] Inventors: Markus Schmid, Zürich; Heinrich Marti, Forch, both of Switzerland

[73] Assignee: Concast AG, Zürich, Switzerland

[21] Appl. No.: 792,233

[22] Filed: Apr. 29, 1977

[30] Foreign Application Priority Data

May 7, 1976 Switzerland ..... 5736/76

[51] Int. Cl.[2] ..... G01B 5/24; B22D 11/10

[52] U.S. Cl. ..... 33/333; 33/182; 33/346; 33/366; 164/150

[58] Field of Search ..... 33/181 R, 182, 333, 33/346, 366, 370, 371, 392, 395, 396, 174 R; 164/4, 150

[56] References Cited

U.S. PATENT DOCUMENTS

| | | | |
|---|---|---|---|
| 1,507,930 | 9/1924 | McDonough | 33/182 |
| 1,952,745 | 3/1934 | Deasy | 33/370 |
| 2,414,092 | 1/1947 | Charwinsky | 33/333 |
| 2,498,460 | 2/1950 | Shenefelt | 33/392 |
| 3,151,402 | 10/1964 | Gelgessen | 33/333 |
| 3,372,386 | 3/1968 | Klinger | 33/366 |

*Primary Examiner*—Richard E. Aegerter
*Assistant Examiner*—Richard R. Stearns
*Attorney, Agent, or Firm*—Werner W. Kleeman

[57] ABSTRACT

A measuring apparatus for determining the position of a roller apron of a continuous casting installation comprising at least one partially curved roller apron, wherein calibrated plumb bobs or lines can be applied to coordinate-measuring points of the roller apron for projecting the position of the measuring points in the x-axis or z-axis into a substantially horizontal measuring plane. Along the roller apron there are applied at a number of such coordinate-measuring points the calibrated plumb bobs or lines at the reference distance in the y-axis between the momentary or related measuring point and the measuring plane.

11 Claims, 3 Drawing Figures

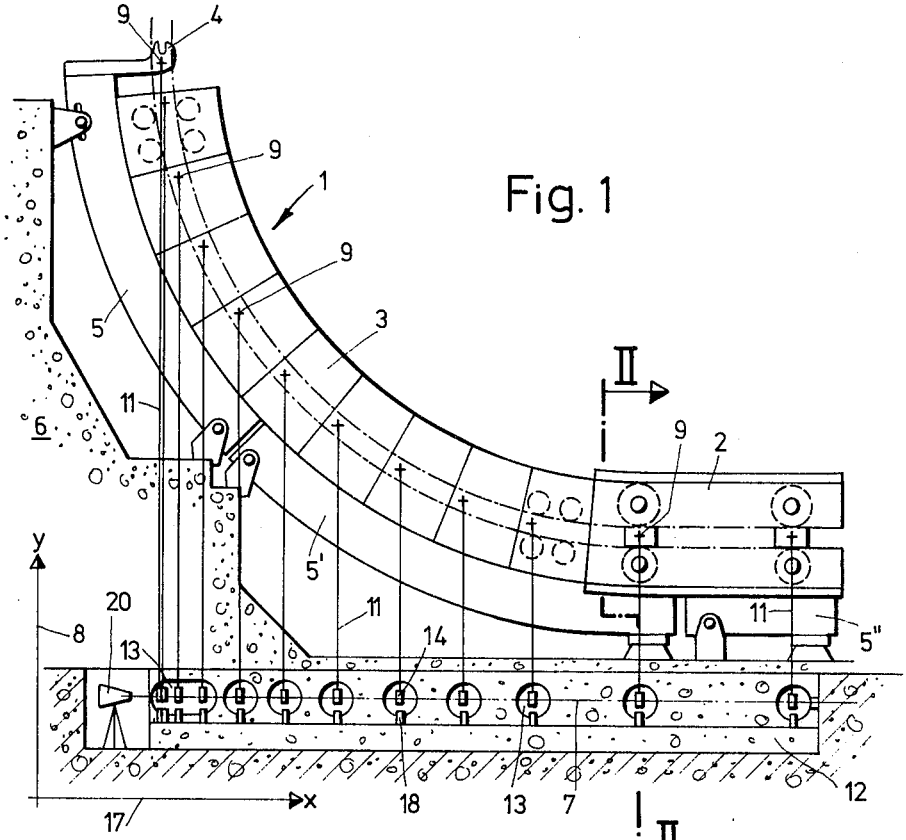
Fig. 1
Fig. 2
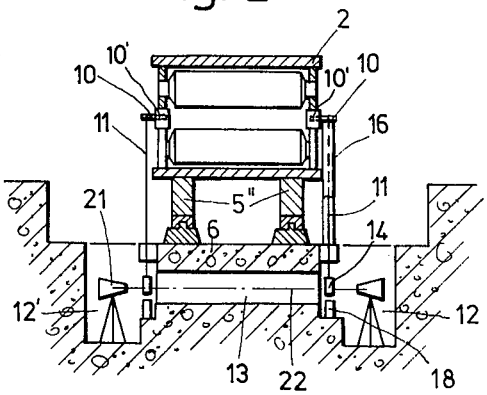
Fig. 3
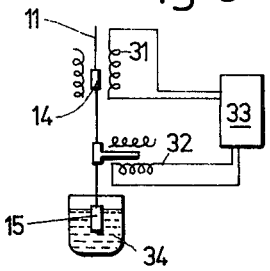

MEASURING APPARATUS FOR DETERMINING THE POSITION OF THE ROLLER APRON OF A CONTINUOUS CASTING INSTALLATION

BACKGROUND OF THE INVENTION

The present invention relates to a new and improved construction of measuring apparatus for determining the position of a roller apron in a continuous casting installation comprising an at least partially curved roller apron or strand guide arrangement, wherein there can be applied to measuring points of the roller apron plumb bobs or lines which project the position of the measuring points in the x-axis or z-axis, respectively, into a substantially horizontal measuring plane.

During the continuous casting of metals, especially steel, an exact alignment of the position of the roller apron or strand guide arrangement in the secondary cooling zone in an absolute requirement for the good quality of the cast product. Yet, the roller apron or strand guide assembly is however subjected during the casting operation, especially when working with pours lasting over a longer period of time, to the thermal radiation which oftentimes alters the geometry of the roller apron. This can result in reduction of the quality of the cast strand by the formation of fissures, especially when casting specialty steels.

During the assembly of the continuous casting installation, especially in the case of a slab-and large bloom-casting installation, there have become known to the art conventional measuring devices for the alignment of the roller apron, such as levelling devices, plumb bobs, bubble levels, radian calibers and so forth. Additionally, after placing the plant into operation it is appropriate to carry out at certain time intervals a post-checking of the roller apron. When using radian calibers or gauges it is possible to control only relatively short roller apron sections. It is not possible to obtain any information regarding the accuracy of the path of the roller apron through a number of sections, and equally, it is not possible to obtain any information concerning the position and dimensional stability of the base frame and the foundation with such calibers.

There is already known to the art a measuring device for the mounting and the operation of arc-type continuous casting installations which consists of a gauge pivotably arranged at the center of the circular arc. This gauge is equipped with adjustable control pins which can be adjusted to the radius of the guided strand surface. With this apparatus it is possible to exactly assemble and measure the arc-shaped path of the roller apron, especially the fixed side. However, it is not possible to control with the use of such measuring apparatus a completely assembled, operationally-ready roller apron equipped with spray nozzles, hoses, adjustment cylinder and so forth, because there is absent the necessary accessibility to the roller apron elements. During the casting operation there is likewise not possible a measurement for the same reasons and additionally due to the operating conditions and the danger of accidents. Moreover, the measuring apparatus when working with slab- and bloom- continuous casting installations operating with conventionally 8 to 15 meter casting radius is cumbersome and therefore can only be moved with a lifting mechanism, and furthermore, is exposed to large dimensional deviations in its length in the presence of temperature fluctuations.

Furthermore, during the installation of continuous casting plants it is conventional to apply plumb bobs at measuring points of the roller apron. These plumb bobs or lines project the positions of such measuring points into a horizontal measuring plane where the reference value or dimension or its deviations can be determined in the x-axis or z-axis respectively. By means of levelling devices is possible to determine by carrying out angle or trigonometric measurements the positions of the measuring points in the y-axis. Such measurements require a great deal of time during the assembly of the casting installation. When the installation has been assembled into a condition where it is ready for use then the roller apron is surrounded by spray tubes, coverings, hoses, adjustment cylinders and so forth so that it is only possible to measure-out the roller apron by carrying out indirect measurements. A rapid and exact checking of the machine geometry during repair steps or a permanent monitoring during the casting operation and during standstill times, i.e. during the hot- and cold state of the machine, is not possible with the aforementioned measuring devices.

SUMMARY OF THE INVENTION

Hence, with the foregoing in mind it is a primary object of the present invention to provide a new and improved construction of measuring apparatus for determining the position of a roller apron of a continuous casting installation in a manner not associated with the aforementioned shortcomings and limitations of the prior art proposals.

Another and more specific object of the present invention aims at the provision of a measuring apparatus which renders it possible, starting from the initiation of the mounting or assembly work, to monitor the geometry of a curved roller apron and to determine deviations in its magnitude.

It is an additional object of the present invention to provide a novel construction of measuring apparatus which enables detection of deviations in the roller apron geometry between the cold state and the hot state of the machine.

Now in order to implement these and still further objects of the invention, which will become more readily apparent as the description proceeds, the invention contemplates applying along the roller apron at a number of coordinate-measuring points at the reference distance in the y-axis calibrated plumb lines or bobs between the momentary measuring point and the measuring plane.

With the measuring apparatus of the invention it is possible to periodically or permanently check the position and the dimensional accuracy of the roller apron, the base frame and the foundation with very little trouble and expenditure, starting from the time of assembly of the installation and the beginning of the operation, respectively. Due to the extreme accuracy of the roller apron, which is obtainable by means of such measuring apparatus, it is possible to improve the quality of the cast strand. Furthermore, downtimes for the purpose of measuring the casting installation can be reduced or avoided.

The plumb bobs or lines and the horizontal measuring plane can be chosen in accordance with the construction of the machine. The measuring plane is arranged within a free or clear space which enables carrying out the measurement with a levelling device. If necessary, it can be interrupted in a step-like fashion. According to a further feature of the invention, it is advantageous if the measuring plane is dispositioned in a measuring channel laterally of the roller apron and the plumb lines or bobs penetrate through such measuring plane. When using a single measuring plane there can be obtained an increased measuring accuracy. At the same time it is possible to reduce the number of levelling devices.

So as to insure retention of the measuring accuracy even in the presence of temperature fluctuations without taking into account the expansion of the plumb lines the latter are formed of a material having low expansion properties, typically a low coefficient of thermal expansion. The invention therefore proposes the use of INVAR steel for manufacturing such plumb lines or bobs.

The path of the roller apron constitutes a curve-or arcuate shaped surface. In order to be able to monitor this three-dimensional surface, it is especially advantageous in the case of slab casting installations, to arrange measuring channels to both sides of the roller apron. A coordination of the values displayed at both sides of the roller apron by the plumb lines can be obtained, if according to a further advantageous aspect of the invention, the measuring channels arranged to both sides of the roller apron are interconnected by transverse channels.

In order to protect the permanently arranged plumb lines or bobs from thermal radiation, contaminants and so forth, it is advantageous to disposition such plumb lines between the coordinate-measuring points and the measuring channel in closed vertical channels.

The measuring time can be further shortened when marking the reference position of each plumb line in the x-axis or z-axis, respectively, by the use of setting sleeves which are anchored in the foundation.

At the coordinate-measuring points there are advantageously mounted in bores rustproof pins or plugs.

If it is desired, the measuring channel can be structured as a measuring tunnel. Then it is readily possible to walk through such measuring tunnel during the casting operation.

Instead of carrying out a periodic control of the roller apron it may be desired to permanently monitor the strand geometry and to continuously record deviations. To obtain this result, a further facet of the invention contemplates equipping the plumb lines with inductive measuring transmitters, which, in turn, are connected at a monitoring device. The plumb lines are then advantageously equipped with an oscillation or vibration damper or dampening device.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic side view of a roller apron of a continuous casting installation embodying teachings of the present invention;

FIG. 2 is a cross-sectional view of the arrangement of FIG. 1, taken substantially along the line II — II thereof; and FIG. 3 is an electrical device for monitoring the movement of the plumb line or bob.

DETAILED DESCRIPTION OF THE PREFERRED EMBODIMENTS

Describing now the drawings, it is to be understood that in order to simplify the illustration thereof only enough of the structure of the continuous casting installation has been disclosed in order to enable those versed in the art to readily understand the underlying principles and concepts of the present invention. Now in FIGS. 1 and 2 there is shown a strand guide including a roller apron 1 of a curved or arc-type continuous casting installation containing a subsequently arranged withdrawing and straightening machine or unit 2. The roller apron 1 is subdivided into strand guide elements or roller apron elements in the form of segments 3. In order to accommodate the not particularly illustrated conventional continuous casting mold a support or bearing member 4 is conveniently connected with a base frame part 5. The base frame part or base frame 5 which is subdivided into three components or units 5, 5' and 5'', bears upon a concrete foundation 6 in such a manner that in the presence of thermal effects there is possible an expansion in the tangential direction. The support member 4, the segments 3 and the withdrawing and straightening machine 2 are provided with coordinate-measuring points 9. Along the roller apron 1 there are simultaneously applied at a number of coordinate-measuring points 9 at the reference distance in the y-axis 8 calibrated plumb lines or bobs 11 — hereinafter simply referred to as plumb lines — between the momentary or relevant measuring point 9 and a horizontal measuring plane 7. These plumb lines 11 are articulated to rustproof pins 10 set in the bores, generally indicated by reference character 10' and each consist of an INVAR wire (iron-nickel alloy), a measuring cylinder 14 equipped with a calibration marking and a calibration weight 15 (FIG. 3). The plumb lines 11 extend into measuring channels 12 and 12' arranged laterally of the roller apron 1 and also into the measuring plane 7 respectively. The measuring channels 12 and 12' which are arranged to both sides of the roller apron 1 can be interconnected by transverse channels 13. These measuring channels 12 and 12' can be structured as open channels or also as a closed measuring tunnel.

In order to protect the plumb lines 11 there are advantageously provided closed vertical channels 16 between the measuring points 9 and the measuring channels 12. The measuring cylinders 14 project the actual-positions of the measuring points in the x-axis or z-axis respectively. The reference positions are characterized by the setting sleeves 18 in the measuring channels 12 and 12'.

In FIG. 3, the measuring cylinder 14 of the plumb line 11 is equipped with an inductive measuring transmitter 31, which can detect deviations in the y-axis, and an inductive measuring transmitter 32, which can detect deviations in the x-axis. The measuring transmitters 31 and 32 are connected to a monitoring device 33 which is programmed such that when the roller apron 1 remains within a predetermined tolerance at the measuring locations there is illuminated a green light and upon exceeding such predetermined tolerance there is illuminated a red light. In order to annihilate vibrations or oscillations the calibration weight 15 of the plumb line 11 is equipped with a vibration or oscillation damper 34 in the form of an oil bath.

Having now had the benefit of the foregoing discussion of the exemplary embodiment of measuring apparatus for determining the position of a strand guide assembly, such as one including for instance a roller apron of a continuous casting installation, there will hereinafter be considered the mode of operation of such measuring apparatus which is as follows: by means of a levelling device 20 there is determined the horizontal measuring plane 7 in the direction of the x-axis 17 and by means of a levelling device 21 the horizontal transverse axis 22 with respect to the x-axis 17 (i.e. the z-axis). Thereafter, the setting sleeves 18 are mounted in the foundation in accordance with the reference dimension of the x-axis and z-axis respectively. By comparing the position of the measuring cylinders 14 with the position of the setting sleeves 18 it is possible to determine deviations in these two axes visually or by means of the inductive measuring transmitters 31 and 32. The deviations in the y-axis 8 can be determined by the elevational position of the calibration marking or marker at the measuring cylinder 14 of the plumb line 11 by means of the levelling device 20 or with the aid of the inductive measuring transmitter 31. Through the use of the levelling device 21 there can be compared the positions of the coordinate-measuring points of oppositely situated sides of the roller apron 1 and possible deviations determined.

The use of the measuring apparatus is not in any way limited purely in the environment of an arc-type or curved continuous casting installation, rather it also can be used to advantage in the case of vertical casting installations which are followed by a curved roller apron.

Finally, it will be readily understood the terms "x-axis" and "Z-axis" as used in this disclosure and concluding claims may, where appropriate, obviously be interchanged, and in fact, under circumstances, used in the conjunctive.

While there are shown and described present preferred embodiments of the invention it is to be distinctly understood that the invention is not limited thereto, but may be otherwise variously embodied and practiced within the scope of the following claims.

What we claim is:

1. A measuring apparatus for determining the position of a roller apron of a continuous casting installation, comprising:

at least one partially curved roller apron;

means for supporting said roller apron with respect to a base defining a substantially horizontal measuring plane;

said apron containing a number of coordinate-measuring points at which there are means for mounting plumb lines for projecting the position of the measuring points in the x-axis or z-axis into said substantially horizontal measuring plane;

said plumb lines constituting calibrated plumb lines which are applied along the roller apron at said number of the coordinate-measuring points and each have a length in the y-axis corresponding to the desired distance between the related measuring point and the measuring plane.

2. The measuring apparatus as defined in claim 1, further including:

means on said base defining a measuring channel arranged laterally of the roller apron;

said measuring plane being disposed below the roller apron in said measuring channel; and said plumb lines penetrating said measuring plane.

3. The measuring apparatus as defined in claim 2, further including:

means defining closed vertical channels having open upper and lower ends;

said plumb lines being arranged in said closed vertical channels between the coordinate-measuring points and the measuring channel.

4. The measuring apparatus as defined in claim 1, wherein:

each of said plumb lines has a plumb line wire formed of INVAR (iron-nickel alloy).

5. The measuring apparatus as defined in claim 1, further including:

means on said base defining measuring channels arranged to each side of the roller apron.

6. The measuring apparatus as defined in claim 5, further including:

transverse channel means on said base for interconnecting the measuring channels arranged to both sides of the roller apron.

7. The measuring apparatus as defined in claim 1, further including:

each plumb line having a reference position in the x-axis or the z-axis respectively; and setting sleeves anchored in said base for marking the reference position of each plumb line in the x-axis or the z-axis, respectively.

8. The measuring apparatus as defined in claim 1, wherein said mounting means comprises:

rustproof pins mounted in bores at the coordinate-measuring points.

9. The measuring apparatus as defined in claim 1, further including:

inductive measuring transmitters provided for said plumb lines to sense the positions thereof; and a monitoring device connected to said inductive measuring transmitters for giving an indication of said positions.

10. The measuring apparatus as defined in claim 1, further including:

vibration damping means provided for said plumb lines.

11. A measuring apparatus for determining the position of a strand guide of a continuous casting installation, comprising:

at least one strand guide;

means for supporting said strand guide with respect to a base defining a substantially horizontal measuring plane;

said strand guide containing coordinate-measuring points at which there are means for mounting plumb lines for projecting the position of the measuring points along a substantially vertical axis into said substantially horizontal measuring plane;

said plumb lines constituting calibrated plumb lines which are applied along the strand guide at least at given ones of the coordinate-measuring points and each have a length corresponding to the desired distance between the related measuring point and the measuring plane.

* * * * *